United States Patent [19]

Anderson et al.

[11] 4,379,730

[45] Apr. 12, 1983

[54] METHOD OF COATING AN OPEN WEAVE FABRIC

[75] Inventors: Larry C. Anderson, Wrightsville; Robert C. Lausch, Ephrata; Peter J. Sydorko, Lancaster, all of Pa.

[73] Assignee: Armstrong World Industries, Inc., Lancaster, Pa.

[21] Appl. No.: 323,942

[22] Filed: Nov. 23, 1981

[51] Int. Cl.[3] ..... B05D 1/28

[52] U.S. Cl. ..... 156/324; 427/428; 118/249; 118/262; 118/210; 156/72

[58] Field of Search ..... 427/428; 118/249, 262, 118/210; 156/72, 324; 428/95

[56] References Cited

U.S. PATENT DOCUMENTS

| | | | |
|---|---|---|---|
| 687,481 | 11/1901 | Kammerer | 118/262 X |
| 1,493,061 | 5/1924 | Becker | 118/262 |
| 2,016,085 | 10/1935 | Fawkes et al. | 118/210 X |
| 2,257,261 | 9/1941 | Knowlton | 118/262 |
| 3,822,176 | 7/1974 | Harrison | 156/72 X |

*Primary Examiner*—Shrive P. Beck

[57] ABSTRACT

A method of applying a latex coating to a carpet secondary backing by means of an applicator roll and a metering roll which travel in reverse rotation and different tangential speeds. The carpet secondary backing travels between a pressure roll and the applicator roll and a film of a coating material is applied to the backing. The backing is an open weave structure and the coating is applied primarily to the strands of the backing and not particularly to the open area of the backing.

3 Claims, 1 Drawing Figure

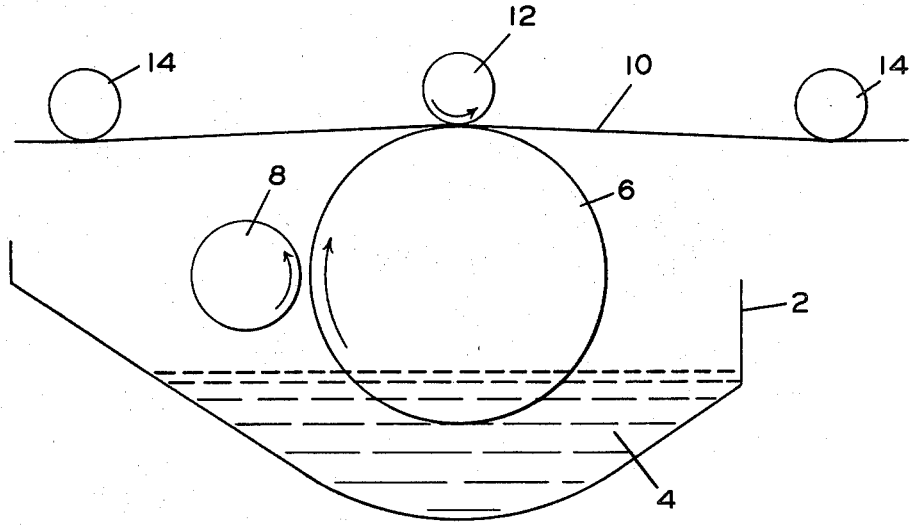
12
14
10
14
8
6
2
4

METHOD OF COATING AN OPEN WEAVE FABRIC

BACKGROUND OF THE INVENTION

1. Field of the Invention

The invention is directed to a method of coating an open weave and, more particularly, to a method of coating a carpet backing with a latex material.

2. Description of the Prior Art

U.S. Pat. No. 2,016,085 discloses a coating process wherein the liquid coating material contained in a fountain is picked up by an applicator roll. A doctor member 15 serves to regulate the amount of lacquer upon the applicator roll and appears to rotate in the opposite direction of that of the applicator roll. The patent also discloses that where the doctor roll was traveling at about 50% of the speed of the applicator roll the ridges and flow lines on the applicator roll would disappear.

U.S. Pat. No. 2,066,782 discloses the concept of utilizing doctor rollers to regulate the thickness of a coating as it is applied to the coating roller. The patent indicates that in the standard type of varnishing machine, the coating roller runs at the same surface speed as that of the paper on the cylinder and that the doctor roller runs at approximately half the speed.

SUMMARY OF THE INVENTION

The invention is directed to a method of applying a coating to an open weave fabric having approximately a 10×10 strand per inch weave. The coating is applied to an applicator roll. The applicator roll passes by a metering roll which controls the thickness of the coating on the applicator roll. The metering roll moves with a tangential speed which is 10% to 15% of the tangential speed of the applicator roll. Both the applicator roll and metering roll move in the same direction at the nip between the two rolls. The applicator roll moves into contact with the opened weave and the open weave passes between the applicator roll and a pressure roll with both rolls having the same tangential speed. The pressure roll applies a light pressure to the fabric and the coating material is forced by the applicator roll into the strands of the fabric with very little coating material being applied to the open area of the weave of the fabric and there being no build-up of globs of coating material on the surface of the fabric.

The pressure roll may be driven so that it moves at a tangential speed greater than the tangential speed of the fabric to wipe the reverse surface of the fabric to push down into the fabric any coating material that may inadvertently have moved through the open weave of the fabric.

BRIEF DESCRIPTION OF THE FIGURE

The FIGURE of the drawing is a schematic view of the apparatus carrying out the invention herein.

DESCRIPTION OF THE PREFERRED EMBODIMENT

The prior art structure for coating material, and particularly for coating paper, is not directly transferable to the coating of open weave fabrics. The use of the prior art structures to process open weaves will result in a "strike-through" of coating material to the back of the fabric and will also provide an uneven and/or excessive application of the coating material to the fabric. What is attempted to be accomplished herein is to apply a 2 to 8 ounces per square yard dry weight latex coating (filled SBR latex) onto a jute carpet backing material which has a weave of 10×10 strands per inch. The weave can be anywhere from 4 to 30 ends per inch in both the warp and weft directions. A strand of yarn material is actually formed of plural fibers and the method herein will result in the working of the latex coating into the individual strands of the yarn so that individual fibers will be covered with a latex. The net result of using the invention herein is that there is a 50% to 400% increase in the lamination strengths for synthetic secondary backing materials compared to current coating techniques.

The invention is carried out by utilizing the apparatus shown in the drawing. A reservoir 2 is provided with a coating material, such as a conventional latex coating material, which is normally used in the carpet industry to coat carpet to bind the secondary backing of the carpet to the carpet fabric. That applicator roll rotates with a portion of its periphery in the bath of the coating material 4. The coating material is picked up on the surface of the applicator roll as the applicator roll moves in a clockwise direction. The surface of the applicator roll containing the coating material passes by a metering roll 8 which rotates in a counter clockwise direction. The metering roll tangential speed is 10% to 15% of the tangential speed of the applicator roll. For example, the applicator roll would be moving at a tangential speed of 40 feet per minute while the metering roll would be moving at a tangential speed of 4–6 feet per minute. The metering roll will wipe against the coating on the surface of the applicator roll and will control the thickness of the coating on the applicator roll. The nip between the metering roll and the applicator roll is normally in the range of 12 to 18 mils. The applicator roll then moves on around towards the open weave fabric 10 which is passing by the upper portion of the applicator roll. The applicator roll moves at a tangential speed which is equal to the line speed or the speed that the fabric moves. A pressure roll 12 exerts a light pressure upon the back of the fabric to push the fabric against the surface of the applicator roll. The pressure being applied by the pressure roll is in the range of 1–15 pounds per lineal inch. In one embodiment of the invention the pressure roll would be moving in the counter clockwise direction with its tangential speed equal to the line speed of the fabric. In another embodiment of the invention, the pressure roll could be motorized so that it was driven at a speed slightly greater than the speed of the fabric and thus there would be caused a wiping action of the surface of the pressure roll against the back of the fabric, and this would in turn force any coating material inadvertently pushed through the fabric back down into the fabric. Conventional rolls 14 will provide a guide structure for the fabric.

There is provided a method for coating an open weave fabric wherein the coating apparatus has an applicator roll 6 for applying the coating to the fabric. A metering roll 8 will control the thickness of the material on the applicator roll. A pressure roll 12 will hold the fabric 10 against the surface of the applicator roll. The fabric will be coated on basically the lower side of the fabric. The fabric is made with an open weave having approximately 10×10 strands per inch of weave. The fabric may be jute or some other type of conventional carpet backing made from synthetic material such as a polypropylene backing material.

The invention herein includes the steps of applying a coating to the applicator roll. This is done by simply passing the applicator roll 6 through a bath 4 of coating material. The coating material, when one is working with a carpet material, can be a conventional latex coating material or a special adhesive material. The applicator roll passes by a metering roll which will control the thickness of the coating on the applicator roll. The metering roll is moved with a tangential speed which is 10% to 15% of the tangential speed of the applicator roll so as to provide a wiping action of the metering roll relative to the applicator roll. Both the applicator roll and metering roll are moving in the same direction at the nip between the two rolls.

The applicator roll then moves into contact with the open weave fabric to be coated by the applicator roll. The applicator roll and fabric both are moving at the same tangential speed. Pressing against the fabric is a pressure roll 12. The pressure roll will let the applicator roll work the coating material into the structure of the strands of material forming the open weave fabric but the pressure is not sufficient to force the coating material into and through the open weave of the fabric. Thus there is provided a coating to the fabric with the coating covering over 90% of the strands of the fabric with very little coating material being applied to the open area of the weave of the fabric and there being no buildup of globs of coating material on the surface of the fabric.

The pressure roll may be motorized and instead of moving along with the fabric may be driven at a slightly greater speed than the fabric to wipe down any coating material that may have inadvertently moved through the open weave of the fabric. If the fabric is moving at a speed of 40 feet per minute, then it is possible that the pressure roll could be moved at a speed of 45–56 feet per minute. Generally, the pressure roll tangential speed is 10% to 40% greater than the tangential speed of the applicator roll.

What is claimed is:

1. A method of coating an open weave fabric wherein the coating apparatus has an applicator roll for applying the coating to the fabric, a metering roll for controlling the thickness of material on the applicator roll and a pressure roll for holding the fabric against the surface of the applicator roll and wherein the fabric being coated is woven with an open weave having approximately 10 by 10 strands per inch, the method comprising the steps of:

a. applying a coating to the applicator roll, b. passing the applicator roll by the metering roll which controls the thickness of the coating on the applicator roll, moving the metering roll with a tangential speed which is 10% to 15% of the tangential speed of the applicator roll so as to provide a wiping action of the metering roll relative to the applicator roll, both said applicator roll and metering roll moving in the same direction at the nip between the two rolls, c. moving the applicator roll into contact with the open weave fabric to be coated with the applicator roll and fabric moving at the same tangential speed, d. pressing the fabric against the applicator roll with a pressure roll at a pressure of about 1–15 pounds per lineal inch to work the coating into the structure of the strands forming the open weave fabric but not sufficient to force the coating into and through the open area of the weave of the fabric whereby the fabric is provided with a coating over 90% of the strands of the fabric with very little coating being applied to the open area of the weave of the fabric and no buildup of globs of coating material on the surface of the fabric.

2. The method of claim 1 wherein the step of applying pressure to the fabric to press it against the applicator roll is carried out by the use of the pressure roll and the further step of moving said pressure roll in the direction of movement of the fabric and at a tangential speed greater than the tangential speed of the fabric to wipe down any coating material that may inadvertently move through the open weave of the fabric.

3. The method of claim 1 wherein the fabric is a carpet secondary backing and the coating is an adhesive and the further step of fastening the adhesive coated secondary backing to a carpet fabric.

* * * * *